United States Patent [19]

Ericsson

[11] Patent Number: 4,909,145

[45] Date of Patent: Mar. 20, 1990

[54] SILKSCREEN PRINTER FOR PRINTING IN OPPOSITE DIRECTIONS

[75] Inventor: Sylve J. D. Ericsson, Tumba, Sweden

[73] Assignee: Svecia Silkscreen Maskiner AB, Sweden

[21] Appl. No.: 173,602

[22] Filed: Mar. 25, 1988

[30] Foreign Application Priority Data

Apr. 1, 1987 [SE] Sweden ..... 8701366

[51] Int. Cl.[4] ..... B41F 15/14

[52] U.S. Cl. ..... 101/123

[58] Field of Search ..... 101/123, 126, 127, 127.1, 101/128.1

[56] References Cited

U.S. PATENT DOCUMENTS

| | | | |
|---|---|---|---|
| 3,505,951 | 4/1970 | Gartrell | 101/123 |
| 3,537,406 | 11/1970 | Ort | 101/129 |
| 4,193,344 | 3/1980 | Ericsson | 101/129 |
| 4,254,707 | 3/1981 | Lambert et al. | 101/129 |
| 4,267,773 | 5/1981 | Scherp et al. | 101/127.1 |
| 4,404,903 | 9/1983 | Cronin | 101/123 |
| 4,462,174 | 7/1984 | Messerschmidt | 101/127.1 |
| 4,589,335 | 5/1986 | Svantesson | 101/114 |
| 4,589,336 | 5/1986 | Klemm | 101/123 |
| 4,715,278 | 12/1987 | Ericsson | 101/123 |
| 4,781,114 | 11/1988 | Ericsson | 101/123 |

FOREIGN PATENT DOCUMENTS

| | | | |
|---|---|---|---|
| 197803 | 3/1978 | Fed. Rep. of Germany | 101/123 |
| 2743234 | 3/1978 | Fed. Rep. of Germany | 101/127.1 |
| 3220489 | 12/1983 | Fed. Rep. of Germany | 101/123 |
| 248640 | 10/1987 | Japan | 101/123 |
| 515661 | 9/1976 | U.S.S.R. | 101/123 |
| 912806 | 12/1962 | United Kingdom | 101/123 |
| 2028721 | 3/1980 | United Kingdom | 101/123 |

*Primary Examiner*—Clifford D. Crowder

*Attorney, Agent, or Firm*—Burns, Doane, Swecker & Mathis

[57] ABSTRACT

A silkscreen printer (1) constructed for printing one and the same pattern by squeegee movement in two mutually opposite and mutually different directions. The silkscreen printer comprises a printing table (2) which is held stationary in relation to the printer chassis (3), a stencil (4) accommodated in a frame (5) above the printing table, and a squeegee arrangement (6, 6') which is arranged for reciprocal movement along the stencil, therewith to press ink through the stencil (4) and onto print material (7) placed on the printing table, such as to transfer the pattern of the stencil (4) onto the material (7). One side of the stencil frame (5) is provided with a first pivot device (8) which is intended for pivotal co-action with a first pivot pin (9) when printing is effected by squeegee movement in a direction towards the first pin (9). The opposite side of the stencil frame is provided with a second pivot device (10) which is intended to be brought into pivotal co-action with a second pivot pin (11) when printing is effected by squeegee movement in a direction towards the second pivot pin. The distance between the first and the second pivot devices (10) is somewhat greater than the distance between the first and the second pivot pins (11).

8 Claims, 1 Drawing Sheet

SILKSCREEN PRINTER FOR PRINTING IN OPPOSITE DIRECTIONS

TECHNICAL FIELD

The present invention relates to a silkscreen printer, and more specifically to a silkscreen printer in which a squeegee is moved in two mutually different and mutually opposite directions for printing one and the same pattern.

To this end the silkscreen printer includes a printing table, which is held stationary in relation to the printer chassis, a stencil which is arranged above the printing table and stretched in a stencil frame, and a squeegee arrangement which is arranged for reciprocal movement along the stencil.

The squeegee arrangement is intended to press ink (or ink paste) through the perforations in the stencil during said reciprocal movement of the squeegee, and onto the print material which is placed on the printing table in a registered position relative to the table or to the stencil pattern, such as to transfer the stencil pattern correctly onto the material.

The present invention relates particularly, but not exclusively, to silkscreen printers of the kind in which one side of the stencil frame can be pivoted about a first pin during a printing operation, by means of a first device located at said one frame side in response to movement of the squeegee arrangement towards the first pin, and in which the other side of the stencil frame can also be pivoted about a second pin when printing is effected by movement of the squeegee arrangement in the opposite direction towards the second pin.

BACKGROUND PRIOR ART

Normally, silkscreen printers are constructed for printing a pattern solely in one direction, wherewith the squeegee arrangement is constructed for movement along the stencil in said one direction, while pushing a collection of ink along the stencil during the printing operation.

The squeegee is then returned quickly to its printing position while smoothing out residual ink, or ink paste, over the stencil, such that when the squeegee arrangement is subsequently moved in the aforesaid one direction the stencil pattern is printed directly onto fresh print material.

It is obvious that the printing rate of the printer could be substantially increased if printing of one and the same pattern could be effected by displacement of the squeegee arrangement in two mutually different and mutually opposite directions.

It is previously known to increase the printing rate of a silkscreen printer, by constructing the printer for printing of one and the same pattern by movement of a squeegee in two mutually different and mutually opposite directions, the printing table of this known silkscreen printer being held stationary in relation to the chassis of the printer.

Silkscreen printers of this known kind are exemplified in German Patent Publication 1 561 112 and Swedish Patent Application 8503432-0 (SE-B-448 424).

SUMMARY OF THE INVENTION

Technical Problems

When considering the prior art, for example the prior art recited in the aforegoing, it will be seen that one technical problem resides in the provision in prior art silkscreen printer constructions intended for printing one and the same pattern by squeegee movement in two mutually different and directly opposite directions, provisions which will enable pattern discrepancies caused by stretching of the stencil during movement thereof to be compensated for in both directions of squeegee movement, when the material to be printed upon is located in one and the same position relative to the printing table and to the stencil pattern, irrespective of the printing direction or the direction of squeegee movement.

It will also be seen that a technical problem resides in the provision in such prior art silkscreen printers, with the aid of simple means, of conditions which will enable the stencil frame and the stencil held therein to be prealigned in relation to the printing table and in relation to material to receive print placed in a registered position on the printing table, when printing is effected by squeegee movement in a first direction, and to enable equally as simple means to be used for pre-orientating the frame correctly when printing is effected by movement of the squeegee in the opposite direction, and where the frame has been displaced during this printing operation such that the stencil pattern will be positioned over the print material registered on the printing table, in a predetermined manner.

It will also be seen that a technical problem resides in the provision of conditions, with the aid of simple means, in a silkscreen printer constructed for printing one and the same pattern by squeegee movement in two mutually different and mutually opposite directions, which will enable a discrepancy to be compensated for in either of the two directions of squeegee movement, solely by providing first and second pins in relation to the printer chassis, and by providing diametrically opposite stencil frame parts or stencil frame sides with devices which co-act with respective pins and which are able to co-act either rotationally with the first pin or the second pin, thereby to effect said compensation.

It will also be seen that a technical problem resides in the provision of conditions, with the aid of simple means, which enable stretching of the stencil which occurs during squeegee movement in a printing operation to be compensated to a given extent, solely by adapting the distance between the first and the second devices This distance shall be somewhat greater than the distance between the first pin and the second pin, and the difference in distance should correspond to or at least essentially correspond to twice the extent to which the print material can be expected to stretch during a printing operation with squeegee movement in one direction.

It will also be seen in the case of silkscreen printers of the aforesaid kind that a technical problem resides in the provision of conditions, with the aid of simple means, which enable the end of the frame remote from the frame end at which said device and said pin are in mutual coaction to be raised progressively during the printing operation in dependence on the momentary position of the squeegee arrangement, therewith to create a suitable release angle.

Finally, it will be seen that a technical problem prevailing with silkscreen printers of the aforesaid kind resides in the provision of conditions which, when one device co-acts with the first pin, at the beginning of a printing sequence, will enable the support surface of the second or other device to rest against the second pin and therewith engender conditions for a sufficient release angle at the commencement of the printing sequence, such as to lift the second device from the second pin progressively during the printing sequence and therewith engender a release angle, this release angle preferably being the same during the whole of the printing sequence.

SOLUTION

The present invention thus relates to a silkscreen printer which is constructed for printing one and the same pattern by squeegee movement in two mutually different and diametrically opposed directions, said printer comprising a printing table which is held stationary in relation to the printer chassis, a stencil held in a frame above the printing table and a squeegee arrangement which can be moved backwards and forwards along the stencil, in contact therewith, such as to press ink through the stencil and onto print material positioned on the printing table, therewith to transfer the stencil pattern onto said material, and in which one side of the stencil frame is pivotally or rotatably arranged about a first pin, via a first device provided on said one frame side, when printing by means of squeegee movement in a direction towards the first pin, and in which the opposite frame side is pivotally arranged around a second pin, via a second device provided on said opposite frame side, when printing by means of squeegee movement in a direction towards the second pin.

In accordance with the invention the distance between the first and the second devices is somewhat greater than the distance between the first pin and the second pin. The pins are preferably stationary in relation to the printer chassis.

In accordance with a further development of the invention the stencil frame is tiltably mounted such as to enable the first device to be caused to co-act with the first pin or the second device to co-act with the second pin.

In accordance with the invention, the end of the frame distal from the momentarily co-acting device and pin can be raised progressively during a printing sequence in dependence on the momentary position of the squeegee arrangement along the stencil.

Finally, in accordance with a further embodiment of the invention, when one device co-acts with its associated pin, and in an initial printing stage, a support surface associated with the other device rests against the other pin.

ADVANTAGES

Those advantages primarily characteristic of a silkscreen printer constructed in accordance with the invention mainly reside in the ability to print one and the same pattern by squeegee movement in two mutually different and mutually opposite directions without needing to take special measures to ensure that the print material is registered correctly in relation to the printing table at different locations thereon as a consequence of the direction in which printing is effected. This advantage is afforded in that the distance between the first and the second devices provided on the stencil frame is greater than the distance between the first and second pins associated with said devices and held stationary in relation to the printer chassis.

The main characteristic features of a silkscreen printer constructed in accordance with the present invention are set forth in the characterizing clause of the following claim 1.

BRIEF DESCRIPTION OF THE DRAWINGS

An exemplifying embodiment at present preferred and exhibiting the characteristic features significant of the present invention will now be described in more detail with reference to the accompanying drawing, in which FIG. 1 is a simplified side view which illustrates the principal construction of a silkscreen printer according to the present invention adapted for printing in a first direction of squeegee movement, whereas

DESCRIPTION OF EMBODIMENTS AT PRESENT PREFERRED

Figure 1:
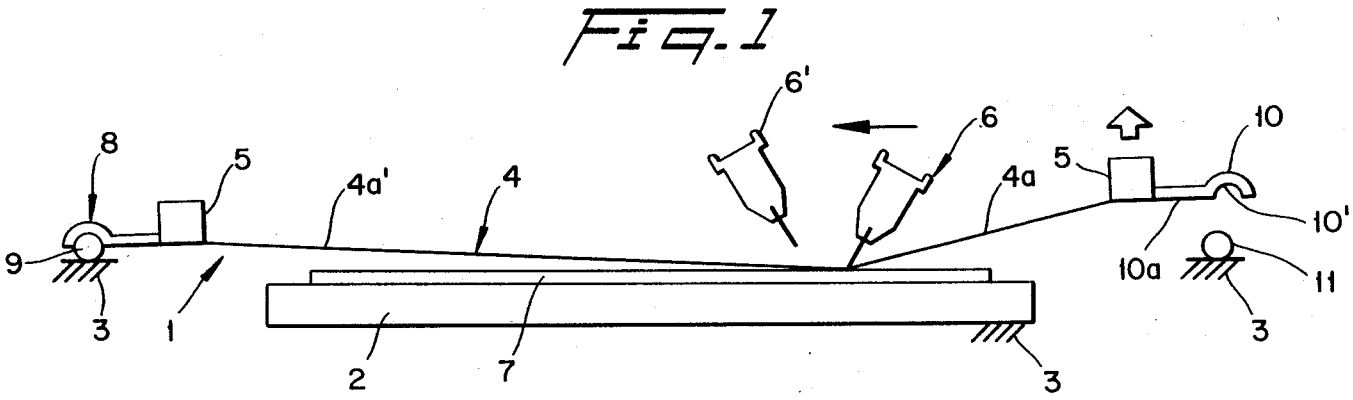

The drawing is thus a highly simplified, side-view illustration of a silkscreen printer which is constructed for printing one and the same pattern on print material during movement of the squeegee in two mutually different and mutually opposite directions, and with which any discepancy caused by stretching of the stencil as the squeegee moves therealong can be compensated for, irrespective of the direction of squeegee movement and with the print material registered in one and the same position on the printing table, and therewith without taking into account the momentary direction of squeegee movement.

The illustrated silkscreen printer 1 has a printing table 2 which is held stationary in relation to the printer chassis 3, this stationary relationship also being indicated at 3.

Located above the printing table 2 is a stencil frame 5 which accommodates a stencil 4. The illustrated printer also includes a squeegee arrangement 6 which is arranged for movement backwards and forwards along the stencil while pressing ink heaped in front of the stencil through the stencil perforations and onto print material 7 positioned on the printing table 2, therewith to transfer the stencil pattern onto the material 7. As will be seen from the respective FIGS., one side, the left side in FIG. 1, of the stencil frame 5 has provided thereon a first pivot device 8 having a first attachment portion 8' which is intended to co-act pivotally with a first pivot pin 9 in response to movement of the squeegee arrangement 6 towards the first pivot pin 9 during a printing sequence. The opposite side, the right side in FIGS. 1 and 2, of the stencil frame 5 is also provided with a similar pivot arrangement, comprising a pivot device 10 attached to said frame side, and a second pivot pin 11, the second pivot device having a second attachment portion 10' which is intended to co-act pivotally with the second pivot pin when the squeegee arrangement 6' moves towards the second pin 11.

As shown in the drawing, the first pivot pin 9 and the second pivot pin 11 are also held stationary in relation to the printer chassis 3.

In accordance with the invention, the distance between the first and second attachment portions 8' and 10' of the first and the second pivot devices 8 and 10 is slightly greater than the distance between the first and second pivot pins 9 and 11.

If it is assumed that the print material 7 is so registered on the printing table 2 that when the frame 5 adopts an intermediate position, between the pivot pins 9 and 11 which is unsuitable for printing, the pattern on the stencil 4 will be correctly projected in relation to the material.

If, however, the pattern is to be transferred through squeegee movement to the left as seen in FIG. 1, and the stencil frame still occupies the aforesaid imagined intermediate position, it will be seen that stretching of the illustrated stencil part 4*a* will cause the pattern to be placed further to the left than the imagined projected pattern.

This means that before printing is commenced the stencil 4 and the frame 5 must be displaced slightly to the right, so as to compensate for this discrepancy.

Should the squeegee 6 adopt the angular position illustrated in FIG. 1 during a printing sequence, the part 4*a* of the stencil will be stretched to a still greater extent and consequently there will be a still greater discrepancy between the projected pattern of the stencil 4 and the actual position in which the pattern is printed on the material 7 during the printing operation.

In order to compensate for this stretch in the stencil, it is proposed that the frame 5 is displaced slightly to the right in FIG. 1 and therewith caused to co-act with the pin 9.

The effect of this stretching and displacement of the stencil, effected through the stencil part 4*a*, is to cause the pattern on the stencil 4 to be transferred correctly onto the print material 7 during the printing operation.

Figure 2:
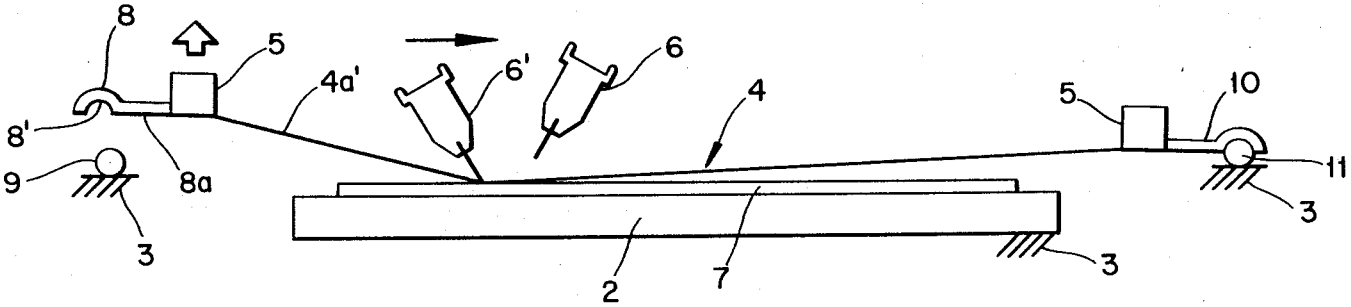
FIG. 2 illustrates the silkscreen printer of FIG. 2 adapted for printing in a second direction of squeegee movement which is directly opposite to the said first direction.

The same sequence of events applies when printing with squeegee movement in the direction shown in FIG. 2, although in this case the frame 5 must first be displaced to the left in said Figure.

It will be seen from FIGS. 1 and 2 that the stencil frame must be both tiltably and displaceably arranged in a manner which will bring the first attachment portion 8' of the first pivot device 8 into co-action with the first pivot pin 9 or the second attachment portion 10' of the second pivot device 10 into co-action with the second pivot pin 11.

Although not shown in the drawing, known means are provided for lifting the end of the stencil frame remote from the pivot device and pin co-acting at that time, in dependence on the momentary position of the squeegee arrangement along the stencil. The further away the squeegee arrangement the higher the stencil frame is lifted so as to obtain a satisfactory release angle between stencil and print material, this angle preferably being the same.

At the beginning of a printing sequence, in which one pivot device is in co-action with its associated pivot pin, a support surface 10*a* of the other pivot device 10 will rest against the other pivot pin 11.

When printing in the opposite direction a similar support surface 8*a* on the other or first pivot device 8 will rest on the pivot pin 9.

It will be understood from the aforegoing that desired displacement of the stencil and frame in relation to the printing table from a "neutral position" is contingent on the prevailing stretch in the stencil part 4*a*.

This means that the difference obtained when subtracting the distance between the pivot pins 9 and 11 from the distance between the first and second attachment portions 8' and 10' of the pivot devices 8 and 10 shall have a value which is equal to twice the displacement desired to compensate for the aforementioned discrepancy, and which corresponds to twice the value of the stretch expected from the stencil during the printing operation.

When the squeegee 6 adopts the attitude illustrated in FIG. 1 and is inclined to the stencil 4 at the illustrated angle, and moves in the illustrated direction, it has been found particularly important to provide conditions which will afford compensation for a relatively pronounced stretch in the stencil material.

Such compensation can be obtained with the illustrated inventive silkscreen printer, simply by changing the horizontal position of the pivot pins 9 and 11 and therewith the distance between said pins, therewith adapting the printer to prevailing stencil stretch in dependence on stencil quality, squeegee material, squeegee pressure against the stencil, etc.

It will be understood that a silkscreen printer in which frame and stencil are displaced further in one direction of squeegee movement than in the opposite direction of squeegee movement also lies within the scope of the invention.

Such conditions may apply when the squeegee 6 adopts one and the same angular position in both directions of squeegee movement and engages the stencil in both of said directions, or when the stencil part 4*a* and corresponding stencil part 4*a'* have mutually different lengths on mutually opposite sides.

It will be understood that the invention is not restricted to the illustrated and described embodiment, and that modifications can be made within the scope of the following claims.

I claim:

1. A silkscreen printer constructed for printing a pattern by squeegee movement in two mutually different and mutually opposite directions, comprising a printing table which is held stationary in relation to a printer chassis, a stencil fitted to a stencil frame above the printing table, and a squeegee arrangement arranged for reciprocal movement along the stencil to press ink through the stencil and onto print material positioned on the table and to thereby transfer the stencil pattern onto the material, one side of said stencil frame being provided with a first pivot device having a first attachment portion to co-act pivotally with a first pivot pin when printing is effected by squeegee movement in a direction towards said first pivot pin, and the opposite side of said stencil frame being provided with a second pivot device having a second attachment portion to co-act pivotally with a second pivot pin when printing is effected by squeegee movement in a direction towards said second pivot pin, the distance between said first and second attachment portions of said first and second pivot devices being greater than the distance between said first and second pivot pins.

2. A printer according to claim 1, wherein said stencil frame may be tiltably arranged to bring said first attachment portion of said first pivot device into co-action with said first pivot pin, or to bring said second attachment portion of said second pivot device into co-action with said second pivot pin.

3. A printer according to claim 2, wherein the end of said stencil frame remote from the co-acting pivot device and pivot pin can be raised during a printing sequence in response to the position of said squeegee arrangement along the stencil.

4. A printer according to claim 3, wherein, during the initial stage of a printing sequence, a support surface on one of said pivot devices rests against an associated one of said pivot pins when the other of said pivot devices is in pivotal engagement with the other of said pivot pins.

5. A printer according to claim 2, wherein, during the initial stage of a printing sequence, a support surface on one of said pivot devices rests against an associated one of said pivot pins when the other of said pivot devices is in pivotal engagement with the other of said pivot pins.

6. A printer according to claim 1, wherein the end of said stencil frame remote from the co-acting pivot device and pivot pin can be raised during a printing sequence in response to the position of said squeegee arrangement along the stencil.

7. A printer according to claim 6, wherein, during the initial stage of a printing sequence, a support surface on one of said pivot devices rests against an associated one of said pivot pins when the others of said pivot devices is in pivotal engagement with the other of said pivot pins.

8. A printer according to claim 1, wherein, during the initial stage of a printing sequence, a support surface on one of said pivot devices rests against an associated one of said pivot pins when the other of said pivot devices is in pivotal engagement with the other of said pivot pins.

* * * * *